United States Patent [19]

Cullity

[11] 4,271,926

[45] Jun. 9, 1981

[54] ROTATABLE WORK PLATFORM

[75] Inventor: Richard E. Cullity, La Mirada, Calif.

[73] Assignee: Mark Industries, Carson, Calif.

[21] Appl. No.: 118,429

[22] Filed: Feb. 4, 1980

[51] Int. Cl.[3] ..... B66F 11/04

[52] U.S. Cl. ..... 182/2; 182/63; 182/141

[58] Field of Search ..... 182/2, 141, 148, 62.5, 182/63

[56] References Cited

U.S. PATENT DOCUMENTS

| | | | |
|---|---|---|---|
| 2,646,182 | 7/1953 | Maas | 182/2 |
| 2,998,861 | 9/1961 | Hotchkiss | 182/2 |
| 3,056,465 | 10/1962 | Gerrans | 182/2 |
| 3,233,700 | 2/1966 | Myers | 182/2 |
| 3,462,103 | 8/1969 | Strom | 182/2 |
| 3,605,941 | 4/1971 | Edwards | 182/2 |
| 3,709,322 | 1/1973 | Mitchell | 182/62.5 |
| 3,841,436 | 10/1974 | Grove | 182/2 |
| 3,937,340 | 2/1976 | Grove | 182/2 |

*Primary Examiner*—Reinaldo P. Machado
*Attorney, Agent, or Firm*—Robert R. Thornton

[57] ABSTRACT

A work platform frame is connected to a vertically disposed pin fixed to one end of a boom. An idler bracket is also pivotally mounted on the pin and has outwardly extending first and second idler arms, which are offset, with respect to each other, by between 90° and 120°. A first hydraulic assembly is connected between the first idler arm and the work platform frame. A second hydraulic assembly is connected between the second idler arm and the boom. Hydraulic fluid is selectively applied to the first and second hydraulic assemblies to cause rotation of the work platform about the pin through an arc of 180°, each hydraulic assembly and its associated idler arm accounting for 90° of such rotation.

9 Claims, 6 Drawing Figures

Fig. 1
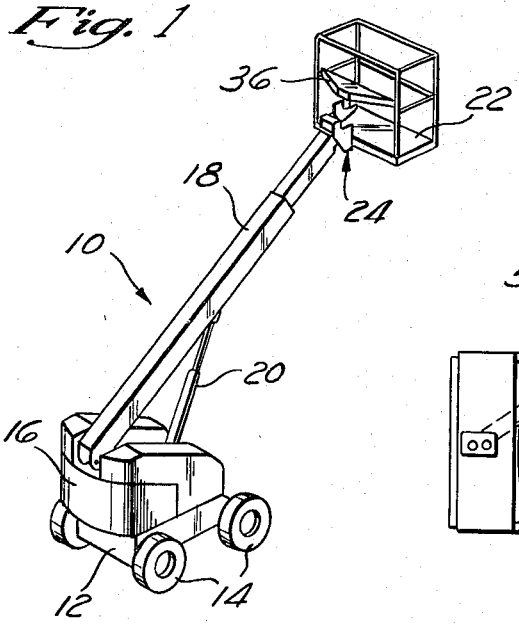
Fig. 3
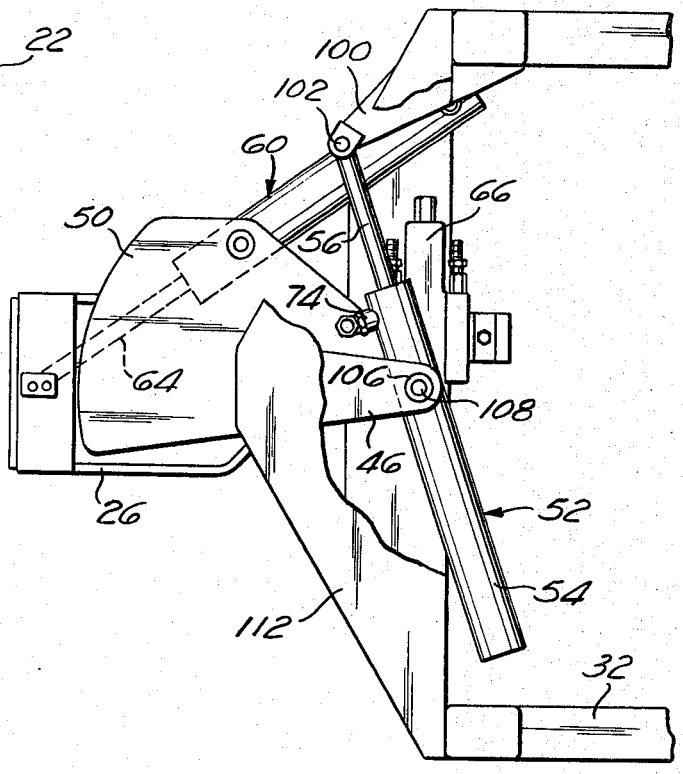
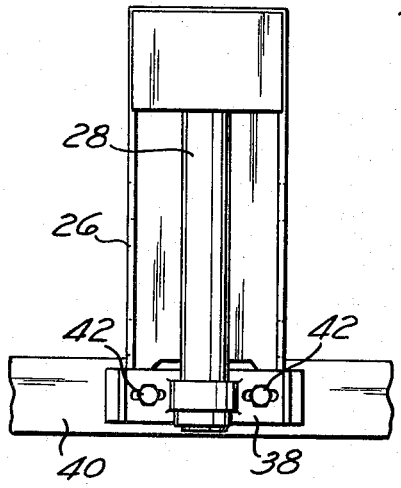
Fig. 4
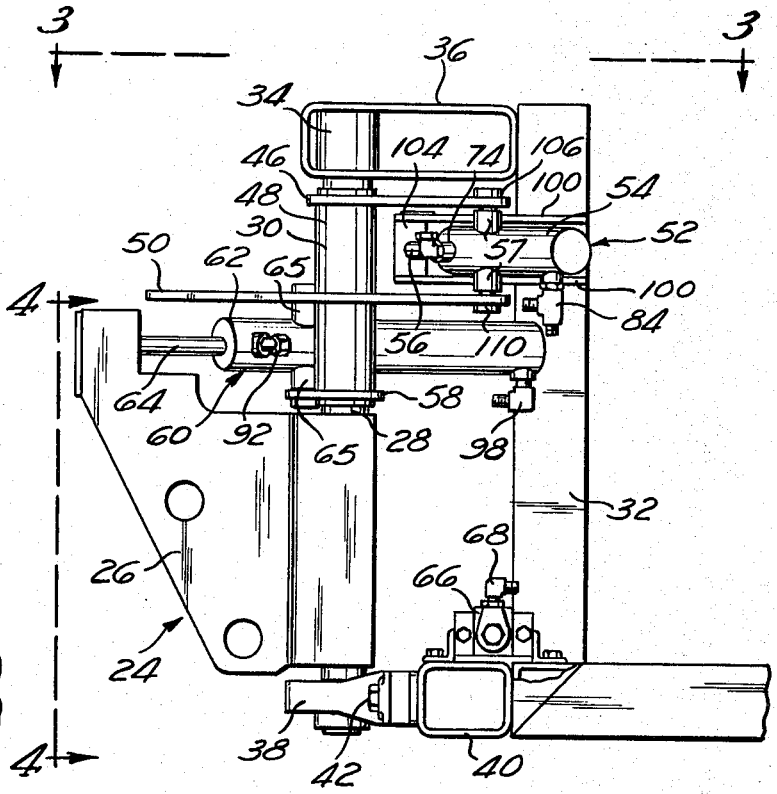
Fig. 2

Fig. 5
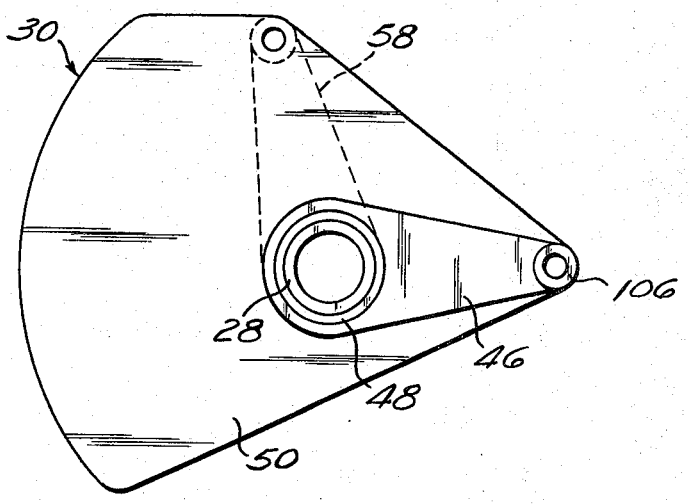
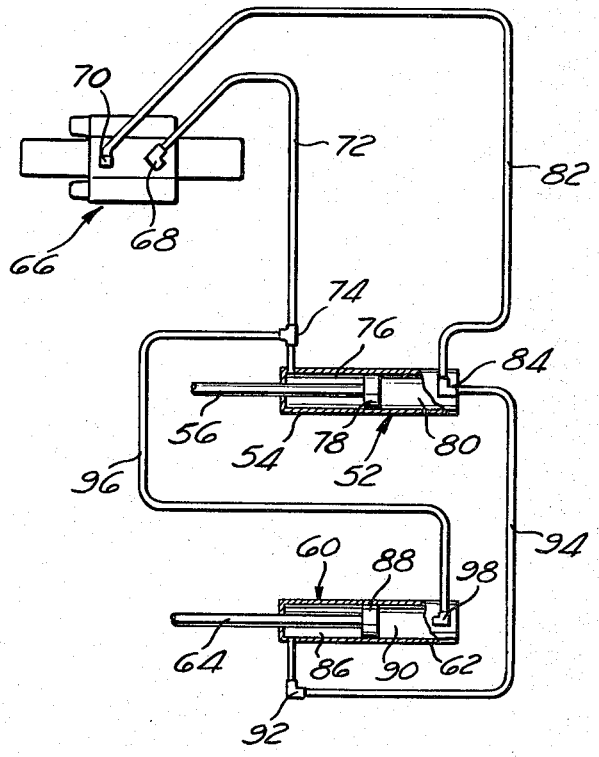
Fig. 6

ROTATABLE WORK PLATFORM

BACKGROUND AND SUMMARY OF THE INVENTION

This invention relates to apparatus for rotating the work platform on a boom type lift.

Boom type lifts are well known. Such lifts normally have a work platform attached to the end of a boom which may be either fixed in length or extensible. The work platform is normally fixed to the end of the boom with respect to rotation, but may utilize a vertically pivotal, self-leveling connection, so as to maintain the work platform in a position with a horizontal floor for comfort and safety of the workmen.

A device to permit the work platform to be rotated are illustrated in U.S. Pat. No. 3,605,941, issued Sept. 20, 1971, which provides for manual rotation of the work platform. An electrically driven chain drive platform rotation apparatus is shown in U.S. Pat. No. 3,709,322, issued Jan. 9, 1973. In U.S. Pat. No. 3,841,436, issued Oct. 15, 1974, a rotary hydraulic motor is utilized to rotate the work platform. However, none of these devices has received widespread acceptance in the industry, due to their particular constructional features, such as manual operation, additional expense of components involved, and the like.

According to the present invention, apparatus for the 180° rotation of a work platform on a boom lift includes a pivot pin which is attached to the end of the boom so that the pin is disposed substantially vertically. A work platform frame is pivotally connected to the pin. An idler bracket is also pivotally mounted on the pin and has a first idler arm and a second idler arm, each of which extend outwardly horizontally from the pin and which are offset, one with respect to the other, at an angle of from about 90° to about 120°. A first hydraulic piston and cylinder assembly is pivotally connected between the first idler arm and the work platform frame so that application of hydraulic fluid under pressure to one side of the piston will rotate the frame in a clockwise direction and application of hydraulic fluid under pressure to the opposite side of the piston will rotate the frame in a counterclockwise direction. The total range of movement of the frame with respect to the action of the first hydraulic assembly is approximately 90°. A second hydraulic assembly is pivotally connected between the second idler arm and the boom attaching means so that the application of hydraulic fluid to one side of the second hydraulic piston rotates the bracket in a clockwise direction with respect to the boom and the application of hydraulic fluid under pressure to the other side of the second hydraulic piston rotates the bracket in the opposite direction. Hydraulic fluid under pressure from the hydraulic fluid source is selectively applied to the first and second hydraulic pistons so as to provide a cumulative rotational movement. That is, the clockwise rotation of the frame in response to the first hydraulic assembly is accompanied by clockwise rotation of the bracket in response to the second hydraulic assembly. By such a complementary hydraulic arrangement, rotation of the work platform through an arc of about 180° is achieved, whereas each cylinder, alone, could only rotate the work platform through an arc of about 90°.

BRIEF DESCRIPTION OF THE DRAWING

The invention may be more readily understood by referring to the accompanying drawing, in which:

FIG. 1 is a side view in perspective of a lift which has a rotational work platform and embodies the present invention;

FIG. 2 is a side elevational view of a work platform rotation apparatus according to the present invention;

FIG. 3 is a view taken along lines 3—3 of FIG. 2;

FIG. 4 is a view taken along lines 4—4 of FIG. 2;

FIG. 5 is a plan view of an idler arm bracket assembly utilized in the work platform rotation apparatus of FIG. 2; and FIG. 6 is a schematic diagram of a hydraulic fluid connection system for use in the present invention.

DETAILED DESCRIPTION OF THE PREFERRED EMBODIMENT

In FIG. 1, there is shown a hydraulic lift 10 having a chassis 12 to which wheels 14 are rotatably attached. The lift 10 has a rotatable body 16 to which a boom 18 is attached. Connected between the body 16 and the boom 18 is a lift cylinder 20 used for raising and lowering the boom 18. At the end of the boom 18 remote from the body 16 a work platform 22 is rotatably attached by a platform rotation apparatus 24.

Referring now to FIG. 2, the platform rotation apparatus 24 is shown in side elevation. The platform rotation apparatus 24 has a self-leveling skirt 26 which is utilized to provide a self-leveling feature for the work platform 22. The self-leveling skirt 26 has a pivot pin 28 fixed to the interior thereof, as is more clearly shown in FIG. 4. The pivot pin 28 extends through an idler arm bracket 30 so that the idler arm bracket 30 is pivotal about the pin 28. A work platform frame 32, the platform itself shown in FIG. 1 being omitted for purposes of clarity, is connected to the pivot pin 28 so as to be rotatable thereabout by means of a thrust washer 34 which engages a lateral frame portion 36 of the work platform frame 32. At the opposite end of the pivot pin 28 from the thrust washer 34, the work platform 32 is attached to the pivot pin 28 by means of a pillow block 38 which is connected to a lower lateral frame portion 40 of the work platform frame 32 by any conventional means, such as bolts 42.

Immediately below the upper lateral frame portion 36, the idler arm bracket 30 has a first idler arm 46 which is connected, at one end, to the bracket 30 at a central cylindrical portion 48 thereof. The idler arm bracket 30 has a main support plate 50 disposed below the first idler arm, as is more clearly shown in FIG. 5. A first hydraulic piston and cylinder assembly 52, having a cylinder 54 out of one end of which a piston rod 56 extends, is mounted between the first idler arm 46 and the main support plate 50 by a pair of trunnions 57 in conventional fashion, so that the first cylinder 54 is pivotal with respect to the first idler arm 46. On the idler arm bracket central cylindrical portion 48 below the main support plate 50, a second idler arm 58 is attached so as to be offset laterally from the first idler arm 46 by approximately 105°, as will be apparent in FIG. 5. Mounted between the second idler arm 58 and the main support plate 50 is a second hydraulic piston and cylinder assembly 60 which includes a second hydraulic cylinder 62 and a second piston rod 64. The second hydraulic piston and cylinder assembly 60 is pivotally mounted between the main support plate 50 and the second idler arm 58 by a pair of trunnions 65.

Connected to the work platform frame 32 at the lower lateral frame portion 40 is a hydraulic control valve 66 which has a straight thread elbow 68 extending outwardly from the top thereof. The hydraulic control valve 66 may be of any conventional dual output type, in which a pair of outlets are utilized with hydraulic fluid under pressure emitted selectively from either one of the two outlets. The hydraulic fluid control valve 66, as is seen in FIG. 6, has a straight thread connector 70 connected thereto so as to provide the second outlet for the hydraulic fluid. The hydraulic fluid control valve 66 may also provide hydraulic fluid for the self-leveling mechanism of the lift 10, if desired, but such forms no part of the present invention.

As seen in FIG. 6, a first hydraulic fluid line 72 is connected between the straight threaded branch tee 74 connected to the first hydraulic piston and cylinder assembly 52 so as to provide a hydraulic fluid connection between the hydraulic fluid control valve 66 and a first rod end reservoir 76 within the portion of the first cylinder 54 through which the piston rod 56 extends, the first hydraulic piston and cylinder assembly 52 having a piston 78 disposed therewithin to which the piston rod 56 is connected by conventional means. The first hydraulic piston and cylinder assembly 52 has a first blind end reservoir 80 on the opposite side of the piston 78 from the first rod end reservoir 76. A second hydraulic fluid line 82 provides a hydraulic fluid connection from the straight thread connector 70 of the hydraulic control valve 66 and the blind end reservoir 82 through a straight thread run tee 84, to which the second hydraulic fluid line 82 is connected.

The second hydraulic piston and cylinder assembly 60 similarly has a second rod end reservoir 86, a second piston 88 and a second blind end reservoir 90. A rod end straight thread elbow 92 is connected to the second piston and cylinder assembly 60 so as to open into the rod end reservoir 86. Connected between the straight thread run tee 84 of the first cylinder 54 and the rod end straight thread elbow 92 of the second cylinder 62 is a second hydraulic fluid line extension 94. A first hydraulic fluid line extension 96 is connected between the first hydraulic assembly straight threaded branch tee 74 and a straight threaded elbow 98 which opens into the second blind end reservoir 90 to provide a hydraulic fluid connection therebetween.

By an inspection of FIG. 6, it will note noted that the first and second piston and cylinder assemblies 52, 60 are connected together by the hydraulic fluid line extensions 94, 96 so that the piston rods 56, 64 will move in opposite directions relative to their cylinders 54, 62 in response to the application of fluid pressure selectively to either the first or second hydraulic fluid lines 72, 82. Thus, application of hydraulic fluid under pressure to the first hydraulic fluid line 72 will cause the piston rod 56 to retract within the cylinder 54 while the second piston rod 64 will be extended further from the cylinder 62. Application of hydraulic fluid under pressure to the second hydraulic fluid line 82 will cause each of the piston rods 56, 64 to move in the opposite direction from that just described.

Operation of the platform rotation apparatus will now be described. As is seen in FIG. 5, the idler arm 46, 58 are angularly offset from one another about the axis of the pin 28 by about 105° in order, in particular configuration shown, to provide for rotation of the work frame 32 through an arc of 180°, while insuring that the cylinder 54 does not extend overly into the working area of the work platform. Such extension or movement could result in injury to the workman. In the configuration shown, each of the hydraulic piston and cylinder assemblies 52, 60 can move the work platform through an arc of 90°, the first hydraulic assembly 52 moving the platform frame 32 relative to the idler arm bracket 30 and the second assembly 60 moving the idler arm bracket 30 relative to the self-leveling skirt 26. The self-leveling skirt is fixed laterally with respect to the longitudinal axis of the boom 18. In the preferred embodiment shown, both the first and second cylinders act sequentially to provide a simultaneous rotation of the work frame 32 relative to the boom skirt 26 in the desired direction.

The hydraulic cylinders 52, 60 pivot, relative to the main support plate 50 during rotation of the work platform. To facilitate this rotation, the piston rods 56, 64 are pivotally attached to the platform frame 32 and the skirt 26, respectively, by any conventional means, such as a pin extending through an eye formed on the end of the rod and fixed to the skirt or frame, this permitting rotation of the rod. In the particular embodiment shown in FIGS. 2 and 3, for example, a bracket 100 is welded to the work platform so as to extend toward the skirt. A rod pivot pin 102 extends through the bracket 100 and through a cylindrical eye 104 to which the rod 56 is attached. Thus, the rod 56 can pivot relative to the bracket 100 during extension and retraction. The idler arm 46 has a hollow base 106 formed at the end thereof, to which a cylinder pivot pin 108 is fixed by a roll pin (not shown) which extends horizontally through the base 106 and the pin 108 to extend into one of the trunnions 57. A second base 110 and a second cylinder pivot pin similarly pivotally connect the other trunnion 57 to the main support plate 50.

The work platform 32 has a shield 112 at the top thereof, so as to cover the cylinder assembly 52 and protect the polished piston rod 56 against dirt, nearby obstructions and falling objects. The piston rod 64 is similarly protected by the main support plate, which extends over the rod 64.

If desired, the application of the pressurized hydraulic fluid to the cylinder assemblies 52, 60 may be sequential, so that, in the particular configuration shown in FIGS. 2–5, the movement of the bracket with respect to the boom either precedes or follows the movement of the platform frame with respect to the bracket. Such sequential operation is accomplished for example utilizing application of the pressurized hydraulic fluid between inlets of the first and second cylinders in response to limit-actuated switches which are actuated in response to the bracket reaching the limits of its angular rotation to commerce rotation of the frame with respect to the bracket. However, it has been found that smoother overall operation results from the parallel application of fluid under pressure to the cylinder assemblies, rather than the sequential application thereof. Thus, in the particular embodiment of plumbing connections shown in FIG. 6, the selective application of hydraulic fluid under pressure to the first hydraulic fluid line 72 will cause the rotation of the piston rod 56 and the further extension of the piston rod 64 so as to rotate the work frame 32 in a clockwise direction. Alternatively, the selective application of hydraulic fluid under pressure to the second hydraulic fluid line 82 will similarly rotate the work frame 32 in a counterclockwise direction.

The invention claimed is:

1. Apparatus for the reciprocal rotation of a work platform on a boom lift comprising:

a pivot pin;

means for attaching said pin to the boom at the end thereof remote from the lift so that the pin is disposed substantially vertically;

a work platform frame;

means for attaching said work platform frame to the pin so that the platform frame is pivotally rotatable about the pin;

an idler bracket pivotally mounted on the pin;

a first idler arm mounted on said bracket so as to extent outwardly horizontally from the pin;

a first hydraulic piston and cylinder assembly of the dual actuation type, said first hydraulic cylinder having a first reservoir and a second reservoir formed within the first cylinder by the first piston and a first piston rod connected to the first piston and extending out of the first cylinder at one end thereof;

means connecting the first hydraulic assembly between the first idler arm and the work platform frame so that the first piston rod is pivotally attached to one thereof and the first cylinder is pivotally attached to the other thereof, whereby the first piston moves relative to the first cylinder in response to the application of hydraulic fluid under pressure to the first reservoir to rotate the frame in a clockwise direction to a first relative position with respect to the idler arm bracket and the piston moves relative to the cylinder in response to the application of hydraulic fluid under pressure to the second reservoir to rotate the frame in a counterclockwise direction to a second relative position with respect to the idler arm bracket, said second frame relative position being displaced counterclockwise about90° from said first frame relative position;

a second idler arm mounted on said bracket so as to be vertically offset from the first idler arm and to extend outwardly horizontally from the pin, said second idler arm being laterally offset between 90° and 120° from the first idler arm;

a second hydraulic piston and cylinder assembly of the dual actuation type, said second hydraulic cylinder having a third reservoir and a fourth reservoir formed within the second cylinder by the second piston and a second piston rod connected to the second piston and extending out of the second cylinder at one end thereof;

means connecting the second hydraulic assembly between the second idler arm and the boom so that the second piston rod is pivotally attached to one thereof and the second cylinder is pivotally attached to the other thereof, whereby the second piston moves relative to the second cylinder in response to application of hydraulic fluid under pressure to the third reservoir to rotate the idler arm bracket in a clockwise direction to a first relative position with respect to the boom and the piston moves relative to the second cylinder in response to the application of hydraulic fluid under pressure to the fourth reservoir to rotate the idler arm bracket in a counterclockwise direction to a second relative position with respect to the boom, said second idler arm bracket relative position being displaced counterclockwise about 90° from said idler arm bracket first relative position; and means for selectively applying hydraulic fluid under pressure to at least one of said reservoirs to initiate the rotary movement of the frame with respect to the boom in a first predetermined direction.

2. Apparatus according to claim 1, and including means for selectively applying hydraulic fluid under pressure to at least another one of said reservoirs to initiate rotary movement of the frame with respect to the boom in a second predetermined direction opposite to the first predetermined direction.

3. Apparatus according to claims 1 or 2, and in which the means for selectively applying hydraulic fluid under pressure to at least one of said reservoirs applies hydraulic fluid under pressure to both the first and third reservoirs.

4. Apparatus according to claim 2, and in which the means for selectively applying hydraulic fluid under pressure to at least another one of said reservoirs applies hydraulic fluid under pressue to both the second and fourth reservoirs.

5. Apparatus according to claim 3, and in which the hydraulic fluid is applied to the reservoirs simultaneously.

6. Apparatus according to claim 3, and in which the hydraulic fluid is applied to the reservoirs sequentially.

7. Apparatus according to claim 4, and in which the means for selectively applying hydraulic fluid under pressure to at least one of said reservoirs applies hydraulic fluid under pressure to both the first and third reservoirs.

8. Apparatus according to claim 7, and in which the hydraulic fluid is applied to either the first and third reservoirs or the second and fourth reservoirs simultaneously.

9. Apparatus according to claim 7, and in which the hydraulic fluid is applied to either the first and third reservoirs or the second and fourth reservoirs sequentially.

* * * * *

UNITED STATES PATENT AND TRADEMARK OFFICE

CERTIFICATE OF CORRECTION

PATENT NO. : 4,271,926

DATED : June 9, 1981

INVENTOR(S) : Richard E. Cullity

It is certified that error appears in the above-identified patent and that said Letters Patent are hereby corrected as shown below:

| | |
|---|---|
| Column 3, line 66 | "58" should read "60" |
| Column 5, line 16 | "extent" should read "extend" |
| Column 6, line 35 | "pressue" should read "pressure" |

Signed and Sealed this

First Day of December 1981

[SEAL]

*Attest:*

GERALD J. MOSSINGHOFF

*Attesting Officer*

*Commissioner of Patents and Trademarks*